US006437761B1

(12) United States Patent
Du et al.

(10) Patent No.: US 6,437,761 B1
(45) Date of Patent: Aug. 20, 2002

(54) MONITOR STATUS INFORMATION STORAGE AND DISPLAY

(75) Inventors: Vincent V. Du; Masanobu Kimoto; Yoshihisa Narui, all of San Diego, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

(21) Appl. No.: 08/958,603

(22) Filed: Oct. 27, 1997

(51) Int. Cl.[7] ..... G09G 1/06

(52) U.S. Cl. ..... 345/11; 345/204; 345/618; 345/904; 340/654; 324/555; 324/612

(58) Field of Search ..... 345/11, 10–15, 345/18–27, 211–214, 204, 904, 618; 395/182.21, 182.22, 750.01, 750.03; 340/654; 364/528.31; 324/555, 612, 771

(56) References Cited

U.S. PATENT DOCUMENTS 5,389,952 A * 2/1995 Kikinis ..... 345/212
5,508,721 A * 4/1996 Hattori ..... 345/185
5,703,629 A * 12/1997 Mermelstein et al. ..... 345/213
5,774,116 A * 6/1998 Potsch ..... 345/211
5,777,611 A * 7/1998 Song ..... 345/212
5,786,813 A * 7/1998 Kurikko ..... 345/212
5,808,693 A * 9/1998 Yamashita et al. ..... 348/554
5,901,161 A * 5/1999 Du et al. ..... 714/18
5,943,028 A * 8/1999 Han ..... 345/10
5,956,022 A * 9/1999 Cheng ..... 345/213

* cited by examiner

*Primary Examiner*—Richard Hjerpe
*Assistant Examiner*—Henry N. Tran
(74) *Attorney, Agent, or Firm*—Blakely, Sokoloff, Taylor & Zanman LLP

(57) ABSTRACT

A method for storing status information prior to shutdown of a video monitor due to a failure. An indication of an operational parameter is obtained. Based on the indication, it is determined if the failure occurs warranting shutdown. If the failure occurs, status information is stored in a non-volatile memory for later retrieval during repair. A shutdown sequence is generated to disable the video monitor.

16 Claims, 3 Drawing Sheets

MONITOR STATUS INFORMATION STORAGE AND DISPLAY

BACKGROUND OF THE INVENTION

1. Field of the Invention

The present invention relates to video monitor technology. In particular, the present invention relates to status information storage and display for multi-frequency video monitor.

2. Description of Related Art

There are many causes for failure in video monitors. Examples of these causes include component aging, component and assembly defects, and incorrect usage. When the failed monitor is returned to the manufacturer for repair, it is important to determine these causes as accurately as possible.

One of the most significant clues for diagnosis of problems is the state of the monitor immediately before the failure. By examining the status information immediately prior to failure, repair personnel can quickly identify the source of failure and thus perform the repair effectively.

The prior art video monitor systems do not provide this information. Without the information, the diagnosis is prolonged and the repair becomes a tedious process.

Furthermore, some useful information about the monitor are only shown at the back of the monitor, causing access difficulty. This information may include model number, serial number, and the year of manufacturing. The monitor indication information is useful not only to the test personnel when the monitor is shipped back for repair, but also the user in the field.

Accordingly, there is a need to provide an apparatus and method for storing status information prior to failure and displaying monitor information.

SUMMARY OF THE INVENTION

The present invention discloses a method and apparatus for storing status information prior to shutdown of a video monitor. The method comprising the steps of: (1) obtaining an indication of an operational parameter; (2) determining if a shutdown condition occurs based on the indication; and (3) if the shutdown condition occurs, storing status information in a non-volatile memory, and generating a shutdown sequence to disable the video monitor.

BRIEF DESCRIPTION OF THE DRAWINGS

The features and advantages of the present invention will become apparent from the following detailed description of the present invention in which.

DESCRIPTION OF THE PRESENT INVENTION

The present invention discloses a method for storing status information prior to shutdown. The conditions of the video circuit are constantly monitored. When any of the conditions exceeds the allowable range, the entire set of operational parameters relating to the function of the video monitor is stored in EEPROM before shutdown.

In the following description, for purposes of explanation, numerous details are set forth in order to provide a thorough understanding of the present invention. However, it will be apparent to one skilled in the art that these specific details are not required in order to practice the present invention. In other instances, well known electrical structures and circuits are shown in block diagram form in order not to obscure the present invention unnecessarily.

Figure 1:
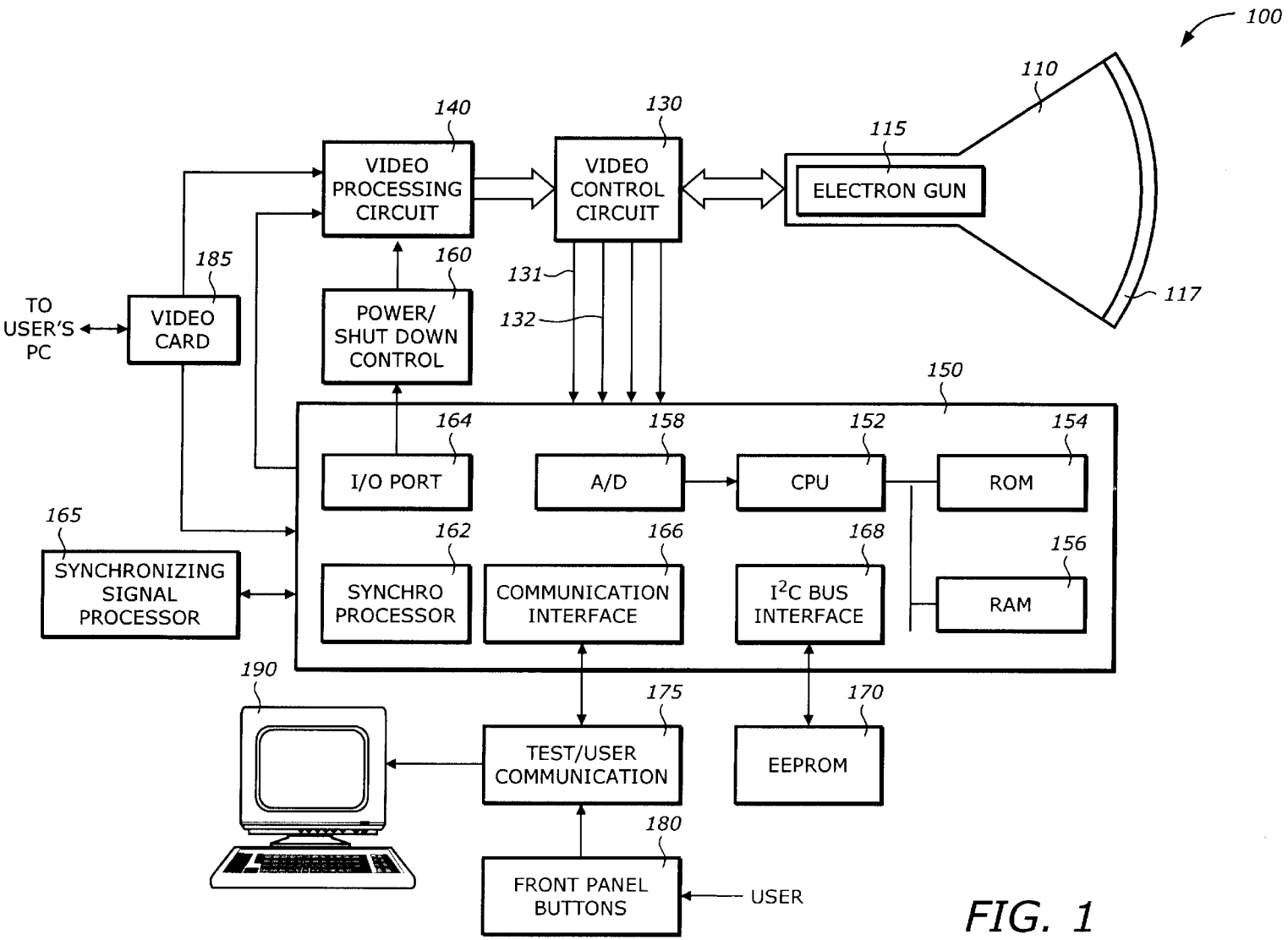
FIG. 1 is a block diagram illustrating one embodiment of a video monitor system that operates in accordance with the teachings of the present invention.

Referring to FIG. 1, a block diagram illustrating one embodiment of a video monitor system 100 that operates in accordance with the teachings of the present invention is shown. The system 100 comprises a picture tube 110, a video control circuit 130, a video processing circuit 140, a processor 150, a power/shutdown control circuit 160, a synchronization signal processor 165, an electrically erasable programmable read only memory (EEPROM) 170, a test/user communication interface circuit 175, a front panel 180, a video card 185, and a test station 190.

Picture tube 110 contains electron gun assembly 115 and phosphor screen 117. Electron gun assembly 115 typically comprises three electron guns corresponding to the red, green, and blue colors. The electron guns emit electron beams that strike the corresponding phosphor to produce picture elements on the screen display.

Video control circuit 130 contains circuitry that control the beam currents and supply voltages to the electron gun assembly 115. The video control circuit 130 also provides feedback information on the operational parameters of the video system. Four important parameters that affect the operation of the video monitor are: the automatic beam current, the high voltage level, the horizontal scan present signal, and the vertical scan present signal. The ABL is expressed as a direct current (DC) voltage which is connected to one analog input channel on the processor 150 via signal line 131. The high voltage level is also a DC voltage connected to one analog input channel on the processor 150 via signal line 132. The horizontal and vertical scan present signals are connected to the input port lines on the processor 150 to the synchro processor 162.

The video processing circuit 140 performs the necessary video control functions. Examples of these control functions include generation of the beam currents, high voltage control, horizontal synchronizing signal, and vertical synchronizing signal. The video processing circuit 140 receives signals from the video card 185, the processor 150, and the power/shutdown control circuit 160.

The processor 150 comprises a central processing unit (CPU) 152, a read only memory (ROM) 154, a random access memory (RAM) 156, and analog-to-digital converter (ADC) 158, a synchro processor 162, an input/output port 164, a communication interface 166, and an $I^2C$ bus interface 168. The processor 150 may be any microprocessor or microcontroller. In one embodiment, processor 150 is a microprocessor having part number ST7275, manufactured by SGS Thomson. The ADC converts an analog voltage to an 8-bit digital data. An analog multiplexer (not shown) is used to selects an analog input voltage from a number of analog inputs for conversion.

The power/shutdown control circuit 160 receives signal from the processor 150 to generate signal to the video processing circuit 140. When a shutdown condition occurs, the power/shutdown control circuit 160 receives a shutdown command signal from the processor 150. The power/shutdown control circuit 160 then proceeds to shutdown the video processing circuit 140 and other functional circuitry in the video monitor system 100.

The synchronization signal processor 165 receives synchronizing signals from the processor 150 and provides various synchronization functions such as vertical and horizontal corrections. In one embodiment, the synchronization signal processor 165 is a processor having part number uPC1886CT manufactured by NEC Corporation in Japan.

The EEPROM 170 stores status information, monitor information, initialization information and other operational parameters. The EEPROM 170 is connected to the Inter-Integrated Circuit ($I^2C$) bus interface 166 inside the processor 150. The $I^2C$ bus is a serial bus for communication between the processor 150 and the EEPROM 170.

The test/user communication interface 175 provides input/output communication to the test station 190 and the front panel 180. The test/user communication interface 175 is connected to the communication interface 166 inside the processor 150. The communication may be serial or parallel.

The front panel 180 provides user interface with buttons or switches. The buttons include a MENU button, and other functional buttons to control the operation of the video monitor.

The video card 185 provides video control information and signals to the video processing circuit 140 and the processor 150. The video card 185 is usually a graphics controller card that stores graphic data and generates horizontal and vertical synchronizing signals. The video card 185 is interfaced with the user's computer system.

The test station 190 is a PC with its own monitor and keyboard. The test station communicates with the processor 150 via the test/user communication interface 175. The test station has several modes of operation. During product adjustment, the test station 190 allows test personnel to adjust functional parameters such as the initialization data, and calibration parameters. When the product is returned for repair, the test station 190 can be used to inquire the nature of the failure. The status information stored in the EEPROM 170 can be retrieved and used by the test station 190.

Figure 2:
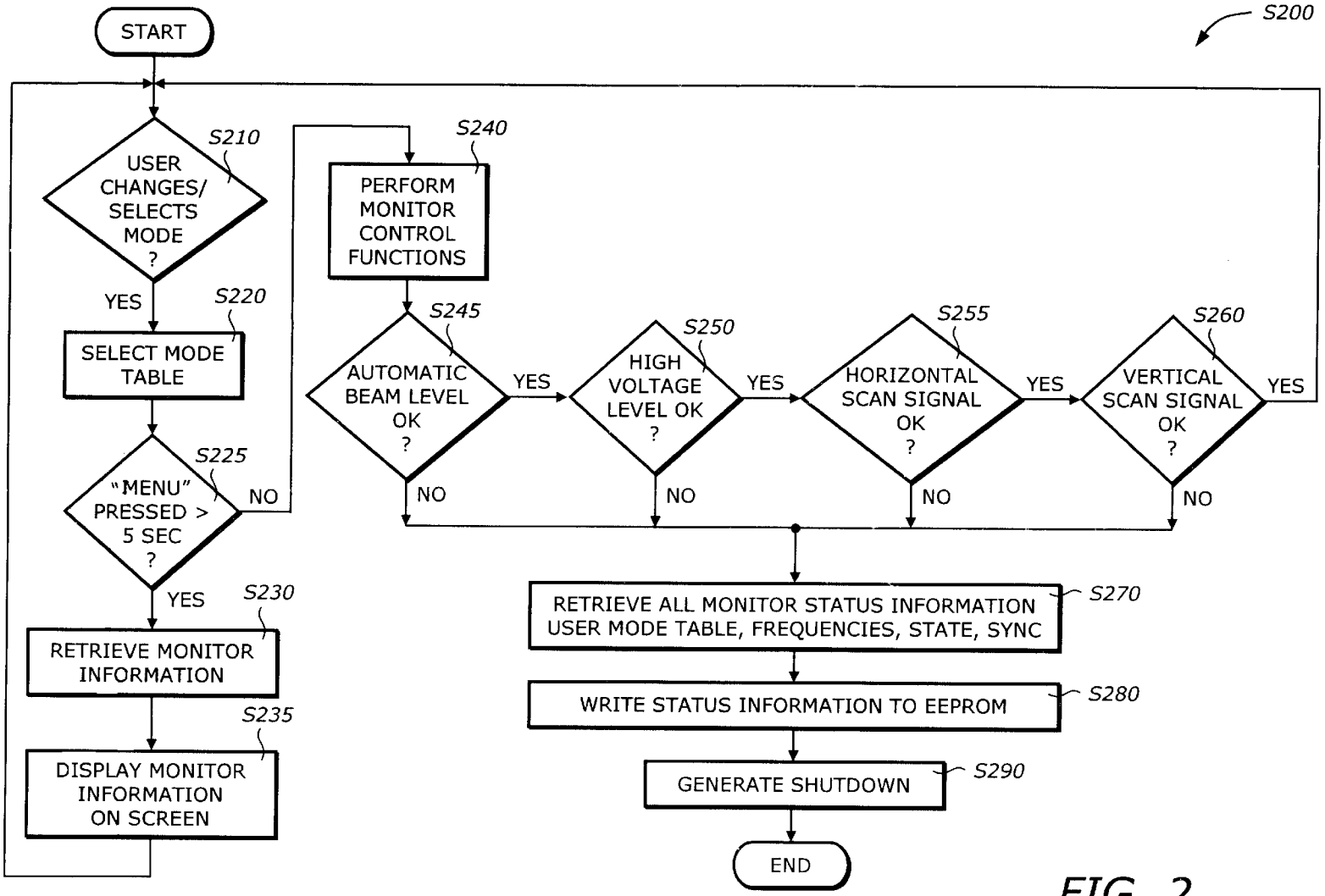
FIG. 2 is a flow diagram illustrating one embodiment of storing status information.

Referring to FIG. 2, a flow diagram illustrating a process S200 to display monitor information and to store status information prior to shutdown is shown.

Proceeding from a START state, the process S200 enters decision step S210 to determine if the user changes or selects an operation mode. If NO, the process S200 comes back decision step S210 again. If YES, the process S200 enters step S220 which selects the mode table according to the user's selection. The mode table includes information regarding user's usage preferences such as frequency.

The process S200 then enters decision step S225 to determine if the MENU button is pressed for more than a predetermined amount of time. In one embodiment, this predetermined period is 5 seconds. If the MENU button is held down for more than 5 seconds, the process S200 enters step S230 to retrieve monitor information stored in ROM or EEPROM. Then the process S200 proceeds to step S235 to display the retrieved information on the monitor screen. The process S200 then returns to decision step S210. If the MENU button is not held down for more than 5 seconds, the process S200 enters step S240 to perform other monitor control functions. These control functions may include processing menu items, generating synchronization signals, and communicating with user's video card 185.

The process S200 then enters decision step S245 to determine if the automatic beam level (ABL) is within the allowable range. In one embodiment, the ABL is an analog voltage provided by the video control circuit 130 in FIG. 1. This analog voltage is digitized by the analog-to-digital converter (ADC) 158 located inside the processor 150 as shown in FIG. 1. The determination involves comparing the digitized ABL voltage with a predetermined maximum value. If the digitized ABL value exceeds this predetermined maximum value, a shutdown condition occurs, causing the process S200 to enter step S270. If the digitized ABL value is less than the maximum value and above a minimum value, the process S200 proceeds to decision step S250.

In the decision step S250, it is determined if the high voltage level is within an acceptable range. The high voltage level (HVL) is an analog voltage provided by the video control circuit 130 in FIG. 1. This HVL is digitized by the ADC 158. This determination is performed by comparing the digitized HVL with a predetermined HVL maximum value and a predetermined HVL minimum value. If the digitized HVL is outside this range, the process S200 enters step S270 to shutdown the video monitor system. If not, the process S200 proceeds to decision step S255.

In the decision step S255, it is determined if the horizontal scan signal is present. The horizontal scan present signal is provided by the synchro processor 162. The synchro processor receives synchronizing signals from the video card 185 and/or the video control circuit 130. In one embodiment, the synchronizing signal comes from the video card 185. In another embodiment, the horizontal sync signal comes from the video control circuit 130. An absence of this signal indicates that a shutdown condition occurs and the process S200 enters step S270. If the horizontal sync signal is present, the process S200 proceeds to decision step S260.

In the decision step S260, it is determined if the vertical scan signal is present. The vertical scan present signal is provided by the synchro processor 162. The synchro processor receives synchronizing signals from the video card 185 and/or the video control circuit 130. In one embodiment, the synchronizing signal comes from the video card 185. In another embodiment, the vertical sync signal comes from the video control circuit 130. An absence of this signal indicates that a shutdown condition occurs and the process S200 enters step S270. If the vertical sync signal is present, the process S200 returns back to decision step S210.

In step S270, all monitor status information at the time the shutdown condition occurs is retrieved. This information includes the following:

User mode table

Horizontal frequency

Vertical frequency

Polarity information for horizontal and vertical frequencies

Monitor state: aging mode, phase-locked mode, sync mode.

Input synchronization: separate sync, sync on green, composite

Additional information can be retrieved.

Process S200 proceeds to step S280 to write the retrieved information to EEPROM This information will then be available to repair personnel for repair diagnosis when the monitor is shipped back to the manufacturer.

Process S200 then proceeds to step S290 to generate the shutdown sequence to the video monitor system. The shutdown essentially includes cutting off power supply to the relevant circuitry in the system. The process S200 then terminates.

Figure 3:
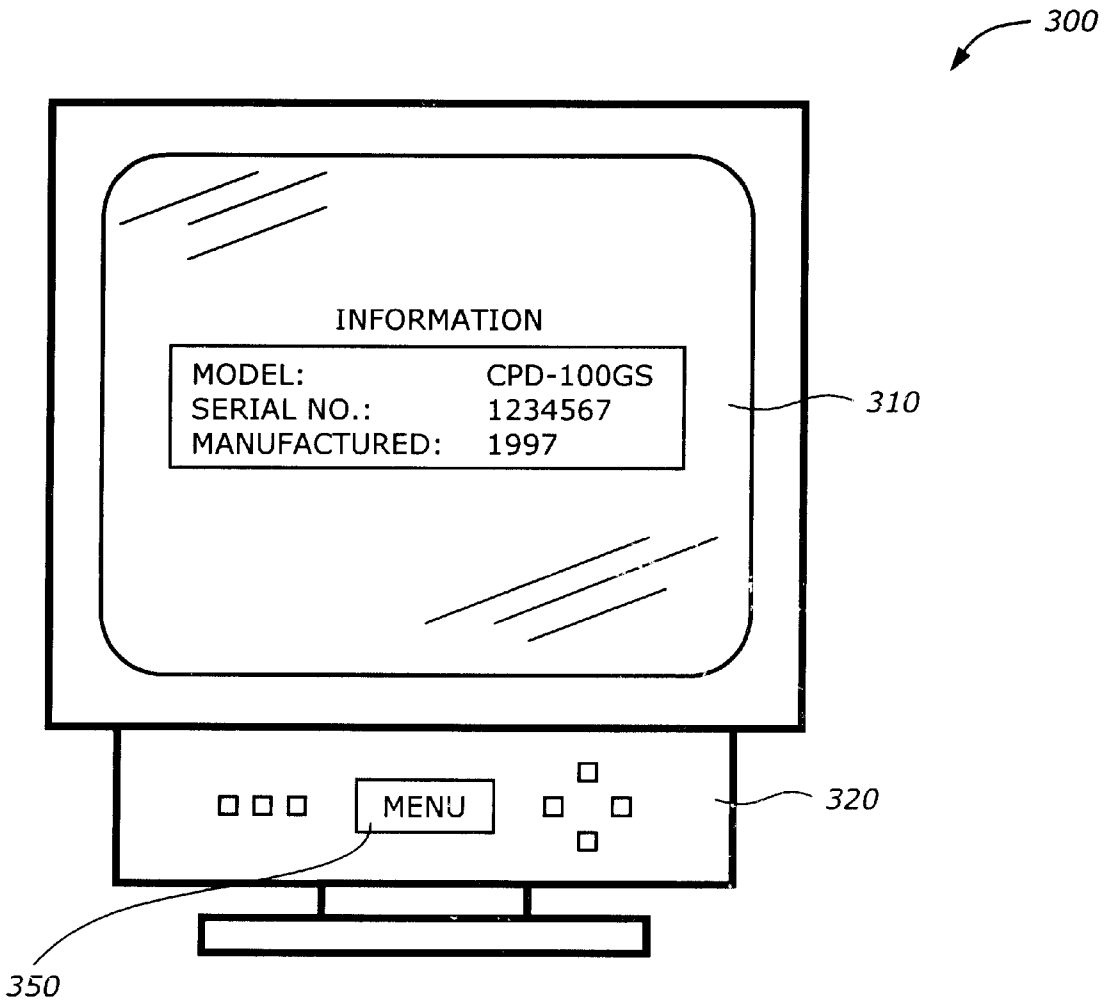
FIG. 3 is a diagram illustrating a display for monitor information.

Referring to FIG. 3, a diagram illustrating the display 300 of the monitor information is shown. The display 300 comprises a monitor information window 310, a front panel 320, and a MENU button The monitor information window 310 comprises information about the monitor such as model number serial number, and year of manufacture. This information is displayed when the user holds the MENU button 350 for more than 5 seconds. The information is displayed until the user selects other display mode. By having the information displayed at the touch of a button, the user can immediately obtain the information rather than having to look at the information in the back of the monitor.

The front panel 320 includes several buttons to allow the user to select operation modes. The MENU button 350 is used to display and allow the user select the menu items. In particular, if the MENU button is held down for more than 5 seconds, the monitor information will be displayed on the screen.

Thus, the status information is stored in EEPROM prior to shutdown to facilitate the diagnosis and repair when the defective monitor is returned. In addition, the display of the monitor indication information on the screen provides immediate access of information to the user and to repair personnel.

While this invention has been described with reference to illustrative embodiments, this description is not intended to be construed in a limiting sense. Various modifications of the illustrative embodiments, as well as other embodiments of the invention, which are apparent to persons skilled in the art to which the invention pertains are deemed to lie within the spirit and scope of the invention.

What is claimed is:

1. A method for storing status information prior to shutdown of a video monitor due to a failure, the method comprising:

obtaining an indication of an operational parameter;

determining, based on the indication, if the failure occurs warranting shutdown; and if the failure occurs, storing status information in a non-volatile memory for later retrieval during repair, and generating a shutdown sequence to disable the video monitor.

2. The method of claim 1 wherein the operational parameter is one of an automatic beam level (ABL), a high voltage level, a horizontal scan signal, and a vertical scan signal.

3. The method of claim 1 wherein determining if the failure occurs includes comparing the indication with a predefined value.

4. The method of claim 1 wherein the status information includes a user mode table, a horizontal frequency, a vertical frequency, a polarity information, a monitor state, and a sync information.

5. The method of claim 4 wherein the monitor state includes an age mode, a phase-locked mode, and a synchronization mode.

6. The method of claim 4 wherein the sync information includes a separate sync, a sync on green, and a composite sync.

7. The method of claim 1 further comprises displaying a monitor indication upon receiving a user input.

8. The method of claim 7 wherein the user input is a holding of a button for a predetermined period of time.

9. A video monitor system comprising:

a picture tube;

a video control circuit coupled to the picture tube for providing control signals and reading an indication of an operational parameter;

a video processing circuit coupled to the video control circuit for generating video signals; and a processor coupled to the video control circuit and the video processing circuit for receiving the indication, the processor determining, based on the indication, if a failure occurs, and if the failure occurs, the processor writing status information to a non-volatile memory for later retrieval during repair before shutting down the video monitor system.

10. The system of claim 9 further comprises a shutdown control circuit coupled to the processor for generating a shutdown command to the video processing circuit.

11. The system of claim 9 further comprises a test interface to allow a retrieval of stored status information.

12. The system of claim 9 wherein the non-volatile memory is an electrically erasable programmable read-only memory (EEPROM).

13. The system of claims 9, wherein the processor includes an analog-to-digital converter which converts the indication into digital data.

14. The system of claim 9 wherein the status information includes a user mode table, a horizontal frequency, a vertical frequency, a polarity information, a monitor state, and a sync information.

15. The system of claim 14 wherein the monitor state includes an age mode, a phase-locked mode, and a synchronization mode.

16. The system of claim 14 wherein the sync information includes a separate sync, a sync on green, and a composite sync.

* * * * *